US009012113B2

(12) United States Patent
Suzuki et al.

(10) Patent No.: US 9,012,113 B2
(45) Date of Patent: Apr. 21, 2015

(54) WHITE TONER, METHOD FOR PRODUCING THE SAME, AND DEVELOPMENT AGENT, RECORDING MEDIUM, PRINTED MATTER, AND IMAGE FORMING APPARATUS USING THE SAME

(71) Applicants: Kazumi Suzuki, Shizuoka (JP); Tatsuya Morita, Kanagawa (JP); Yoshitaka Yamauchi, Shizuoka (JP); Masana Shiba, Shizuoka (JP); Azumi Miyaake, Shizuoka (JP)

(72) Inventors: Kazumi Suzuki, Shizuoka (JP); Tatsuya Morita, Kanagawa (JP); Yoshitaka Yamauchi, Shizuoka (JP); Masana Shiba, Shizuoka (JP); Azumi Miyaake, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/906,736

(22) Filed: May 31, 2013

(65) Prior Publication Data

US 2013/0330522 A1 Dec. 12, 2013

(30) Foreign Application Priority Data

Jun. 11, 2012 (JP) ..... 2012-131664
Feb. 20, 2013 (JP) ..... 2013-030984

(51) Int. Cl.

| | |
|---|---|
| ***G03G 9/00*** | (2006.01) |
| ***G03G 9/09*** | (2006.01) |
| ***G03G 9/08*** | (2006.01) |
| ***G03G 9/087*** | (2006.01) |
| ***G03G 9/097*** | (2006.01) |

(52) U.S. Cl.

CPC ..... *G03G 9/0902* (2013.01); *G03G 9/081* (2013.01); *G03G 9/0812* (2013.01); *G03G 9/08757* (2013.01); *G03G 9/08797* (2013.01); *G03G 9/0926* (2013.01); *G03G 9/09716* (2013.01)

(58) Field of Classification Search

USPC ..... 430/110.1, 108.6, 108.8

See application file for complete search history.

(56) References Cited

U.S. PATENT DOCUMENTS

| | | | | | |
|---|---|---|---|---|---|
| 6,114,077 | A | * | 9/2000 | Voets et al. | 430/97 |
| 6,150,062 | A | * | 11/2000 | Sugizaki et al. | 430/45.55 |
| 2009/0201239 | A1 | * | 8/2009 | Kokeguchi | 345/90 |

FOREIGN PATENT DOCUMENTS

| | | | | |
|---|---|---|---|---|
| JP | 1-105962 | | 4/1989 | |
| JP | 2000-056514 | | 2/2000 | |
| JP | 2003255606 | * | 9/2003 | G03G 9/087 |
| JP | 2005031223 | * | 2/2005 | G03G 15/01 |
| JP | 2006-220694 | | 8/2006 | |
| JP | 2007-041078 | | 2/2007 | |
| JP | 2009-134060 | | 6/2009 | |
| JP | 2009134060 | * | 6/2009 | G03G 15/01 |
| JP | 2010-008816 | | 1/2010 | |
| JP | 2010008816 | * | 1/2010 | G03G 9/09 |
| JP | 2011-150020 | | 8/2011 | |
| JP | 2011-150257 | | 8/2011 | |

OTHER PUBLICATIONS

Machine English language translation of JP2003255606, Sep. 2003.*
Machine English language translation of JP2005031223, Feb. 2005.*
Machine English language translation of JP2009134060, Jun. 2009.*
Machine English language translation of JP2010008816, Jan. 2010.*

* cited by examiner

*Primary Examiner* — Hoa V Le

(74) *Attorney, Agent, or Firm* — Oblon, McClelland, Maier & Neustadt, L.L.P.

(57) ABSTRACT

White toner contains a binder resin, a white pigment, and a releasing agent, wherein the white pigment is coated with the releasing agent and dispersed in the binder resin.

16 Claims, 6 Drawing Sheets

WHITE TONER, METHOD FOR PRODUCING THE SAME, AND DEVELOPMENT AGENT, RECORDING MEDIUM, PRINTED MATTER, AND IMAGE FORMING APPARATUS USING THE SAME

CROSS-REFERENCE TO RELATED APPLICATIONS

This patent application is based on and claims priority pursuant to 35 U.S.C. §119 to Japanese Patent Application Nos. 2012-131664 and 2013-030984, filed on Jun. 11, 2012 and Feb. 20, 2013, respectively, in the Japan Patent Office, the entire disclosures of which are hereby incorporated by reference herein.

BACKGROUND

1. Technical Field

The present invention relates to white toner.

2. Background Art

Full-color images using four colors of yellow, magenta, cyan, and black have been widely used in recent years although electrophotographic images are generally printed in black. In such a case, an image is formed on a white substrate such as paper by using these four color toners. However, good coloring image are not obtained on a colored substrate such as black paper or colored paper or a transparent substrate such as a transparent film by using only four color toners. For this reason, JP-2006-220694-A discloses a method of using white toner as the fifth color toner to make a white background image.

White toner is used to make a white background on a black or colored substrate such as paper, or used for a white background of a transparent substrate such as film. In this case, the white toner is required to have masking characteristics. The masking characteristics mean the ability to hide what exists below the background on which the white toner is fixed. In the case of white color, only a fixed white toner is used for white coloring and it is therefore necessary to scatter and reflect all incident light. If there is a little transmissive light, the obtained image is not vivid or clear.

To solve this problem, for example, JP-H01-105962-A and JP-2000-056514-A disclose improving masking characteristics.

Also, white toner has a specific problem about the fixability in attempts to achieve low temperature fixing by increasing the concentration of pigments to improve the masking characteristics.

Among efforts to solve this problem, JP-2010-008816-A discloses a method of improving the masking characteristics, the low temperature fixability, and the image strength by providing a wider range of selection of toner binder resins by a toner manufacturing method and selecting the surface treatment of titanium dioxide matching the toner manufacturing method. Although this is successful in some extent, the masking characteristics obtained by using a small amount of pigments, which gives rise to a problem of reducing the amount of toner attached.

Also, in general, it is not possible to form a white layer in one pass if the amount of toner attached is required to be more than in the case of typical process color. Accordingly, an attempt to solve this problem is increasing the particle diameter of the white toner. However, it is found that if the particle diameter of the toner is different from those of other color toners, a tandem machine using, in particular, an intermediate transfer element disturbs the other color toner image by transfer thereof.

SUMMARY

The present invention provides a white toner containing at least a binder resin, a white pigment, and a releasing agent, wherein the white pigment is coated with the releasing agent and dispersed in the binder resin.

As another aspect of the present invention, a method for producing toner is provided which includes forming toner particles from a binder resin, a white pigment of titanium dioxide, and a releasing agent of an organic low-molecular material having an acid value of from 1.0 mg KOH/g to 6.0 mg KOH/g through the following step (A) or (B):

(A): melt-kneading the binder resin, the white pigment, and the releasing agent in a temperature condition under which the releasing agent is melted to form a kneaded material followed by grinding and classification thereof, or (B): mixing and dispersing the binder resin, the white pigment, and the releasing agent in a temperature condition under which the releasing agent is melted in an organic solvent to prepare a toner composition solution followed by dispersion and emulsification of the toner composition solution in an aqueous medium phase in the temperature condition.

As another aspect of the present invention, a development agent is provided which contains the white toner mentioned above and toner carrier.

As another aspect of the present invention, a recording medium is provided which includes a substrate and a white image layer formed on at least one surface of the substrate using the white toner mentioned above.

As another aspect of the present invention, a printed matter is provided which includes a substrate, a color image layer, and a white image layer formed of the white toner mentioned above.

As another aspect of the present invention, an image forming apparatus is provided which includes a white image developing device using the white toner mentioned above and a color image developing device.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION

Figure 1:
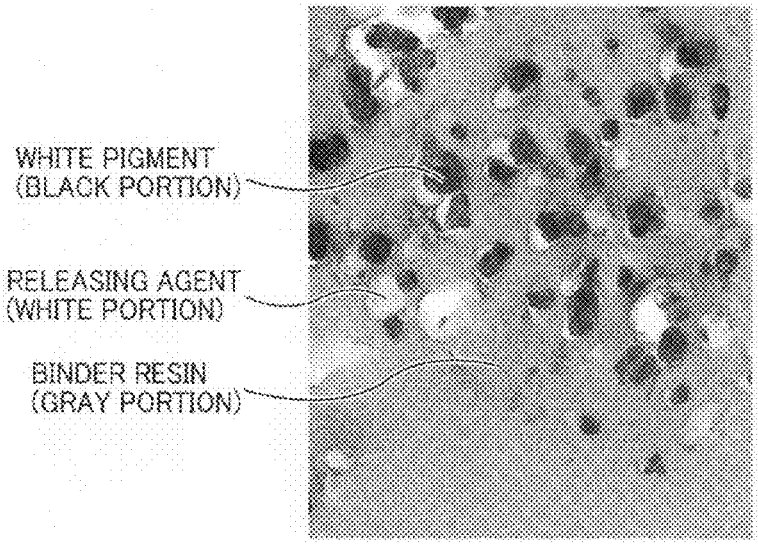
FIG. 1 is a photograph illustrating a cross-section of toner of an Example described later.

The toner of the present disclosure is white toner containing at least a binder resin, a white pigment, and a releasing agent, wherein the white pigment is coated with the releasing agent and dispersed in the binder resin.

That the white pigment is coated with the releasing agent means that part or all of the surface of the white pigment is coated with the releasing agent.

The toner material for use in the white toner is described below.

White Pigment

A titanium dioxide pigment, zinc oxide, calcium carbonate, or the like is preferably used as the white pigment of the present disclosure. Among these pigments, a titanium dioxide pigment is particularly preferable.

Moreover, the titanium dioxide pigment is preferably surface-treated with at least a polyol and more preferably coated with at least aluminum, trimethylolpropane, and/or trimethylolethane.

These surface-treated pigments are available from the market and specific examples thereof include, but are not limited to, TIPAQUE PF-739, CR-50-2, and TIPAQUE CR-60-2 (manufactured by Ishihara Sangyo Kaisha Ltd.). Among these, TIPAQUE PF-739 is preferable because the amount of moisture absorption thereof is limited by zirconia treatment.

When the white pigment titanium dioxide is surface-treated with polyol, coupled with the combination with the characteristics of the binder resin and the releasing agent, the white pigment coated with the releasing agent is dispersed in the binder resin.

When the white pigment is not surface-treated, it is not possible to coat the white pigment with the releasing agent in some cases.

The volume average particle diameter of the white pigment is preferably from 200 nm to 300 nm.

It is preferable to add the white pigment in an amount of 30% by mass or more of the toner to obtain sufficient masking ability. However, the influence of the pigment on the properties of the binder resin increases if the volume average particle diameter of the white pigment is 200 nm or less. Also, if the volume average particle diameter of the white pigment is larger than 300 nm, the masking ability itself deteriorates. The volume average particle diameter of the white pigment is more preferably 220 nm to 270 nm.

Also, the white pigment is preferably contained in an amount of from 30% by mass to 50% by mass in the toner, which ensures sufficient masking ability.

Binder Resin

There is no specific limit to the binder resin and any known binder resin can be utes. For example, a polyester resin is preferably used. The binder resin of the embodiment is described with reference to polyester resins.

Monomers constituting the polyester resin are, for example, as follows:

Specific examples of dihydric alcohol components include, but are not limited to, ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, or diols obtained by polymerizing a cyclic ether such as ethylene oxide or propylene oxide with bisphenol A.

It is preferable to use a tri- or more polyhydric alcohol in combination to cross-link the polyester resin.

Specific examples of the tri- or more polyhydric alcohols include, but are not limited to, sorbitol, 1,2,3,6-hexanetetrol, 1,4-sorbitan, pentaerythritol for example, dipentaerythritol and tripentaerythritol, 1,2,4-butanetriol, 1,2,5-pentatriol, glycerol, 2-methylpropanetriol, 2-methyl-1,2,4-butanetriol, trimethylolethane, trimethylolpropane, and 1,3,5-trihydroxybenzene.

Specific examples of acid components used to form the polyester polymer include, but are not limited to, benzenedicarboxylic acids such as phthalic acid, isophthalic acid, and terephthalic acid or their anhydrides, alkyldicarboxylic acids such as succinic acid, adipic acid, sebacic acid, and azelaic acid, or their anhydrides, unsaturated dibasic acids such as maleic acid, citraconic acid, itaconic acid, alkenylsuccinic acid, fumaric acid, and mesaconic acid, unsaturated dibasic acid anhydrides such as maleic acid anhydride, citraconic acid anhydride, itaconic acid anhydride, and alkenylsuccinic acid anhydride. Also, examples of trivalent or more polyvalent carboxylic acid components include trimellitic acid, pyromellitic acid, 1,2,4-benzenetricarboxylic acid, 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxy-2-methyl-2-methylenecarboxypropane, tetra(methylenecarboxy)methane, 1,2,7,8-octanetetracarboxylic acid, EnPol trimer acid, or their anhydrides or partially lower-alkyl esters.

When the binder resin is a polyester resin, it is preferable to use a resin having a weight average molecular weight (Mw) of $8.0\times10^3$ to $5.0\times10^4$ in the molecular weight distribution of gel permeation chromatography (GPC) of the resin soluble in tetrahydrofuran (THF) in terms of the fixability, the offset characteristics, and the preservability. When the weight average molecular weight (Mw) is too small, problems concerning offset characteristics and preservability may occur although the amount of a residual solvent can be reduced. When the weight average molecular weight (Mw) is too large, the amount of the residual solvent is not easily reduced to 200 ppm or less.

The hydroxyl value of the polyester resin of the binder resin is preferably from 20 mg KOH/g to 80 mg KOH/g and more preferably from 25 mg KOH/g to 50 mg KOH/g.

The acid value of the polyester resin is preferably from 0.1 mg KOH/g to 50 mg KOH/g and more preferably from 10 mg KOH/g to 30 mg KOH/g.

As the binder resin which can be used for the toner of the present disclosure, resins may also be used which contain a monomer component capable of reacting with both of the above vinyl polymer component and polyester resin component in at least any one of these components. Specific examples of the monomer which reacts with the vinyl polymer among the monomers constituting the polyester resin component include, but are not limited to, unsaturated dicarboxylic acids such as phthalic acid, maleic acid, citraconic acid, and itaconic acid, or their anhydrides. Specific examples of the monomer constituting the vinyl polymer component include, but are not limited to, those having a carboxyl group or hydroxy group, arcrylates, and methacrylates.

When a polyester polymer, a vinyl polymer, and other binder resin are used in combination, it is preferable that resins having an acid value of from 0.1 mg KOH/g to 50 mg KOH/g account for 60% by mass or more of the entire resins.

In the present disclosure, the acid value of the binder resin component of the toner composition is obtained by the following method. Its basic procedures are based on JIS K-0070.

[1] With regard to the sample, additives are removed or the contents and the acid values of the resin and the component other than the resin are obtained in advance.

A sample pulverized product is weighed precisely in an amount of 0.5 g to 2.0 g to find the weight W (g) of the polymer component. To obtain the acid value of the binder resin from the toner, for example, the acid values and contents of a colorant, magnetic body or the like are measured separately to find the acid value of the binder resin by calculation.

[2] The sample is placed into a 300 ml beaker and 150 ml of a liquid mixture of toluene/ethanol (ratio by volume: 4/1) is added to dissolve the sample.

[3] An ethanol solution of 0.1 mol/l of KOH is used to titrate by using a potentiometric titrator.

[4] The amount of the KOH solution is S (ml) and at the same time, a control (blank) is measured to find the amount of the KOH solution used as B (ml) to calculate the acid value using the following relation (1). In the relation (1), f represents a factor of KOH.

$$\text{Acid value(mg KOH/g)}=[(S-B)\times f\times 5.61]/W \qquad \text{Relation (1)}$$

The glass transition temperature (Tg) of the polyester resin in the toner is preferably from 40° C. to 80° C. and more preferably from 40° C. to 75° C. in terms of the toner preservability. When Tg is too low, the toner tends to deteriorate a high-temperature atmosphere and also, offset tends to occur in the fixing process. When Tg is excessively high, the fixability easily deteriorates.

Preferably, the toner of the present disclosure is obtained by a production method involving a step of dispersing in an aqueous medium an oil phase containing at least a crystalline polyester resin (or its precursor) as the binder resin component in an organic solvent and removing the organic solvent from the obtained 0/W type liquid dispersion.

Binder Resin Precursor

As the binder resin precursor, a binder resin precursor constituted of a modified polyester resin is preferable. Specific examples thereof include, but are not limited to, polyester polymers modified using isocyanate, epoxy, or the like. This precursor undergoes an elongation reaction with a compound (for example, amines) having an active hydrogen group to produce effects on improvement in the fixing temperature width (difference between the lower limit temperature of fixing and hot offset generation temperature).

The polyester polymer is easily synthesized by reacting a known isocyanating agent or epoxidizing agent with a polyester resin used as a base.

Specific examples of the isocyanating agent include, but are not limited to, aliphatic polyisocyanates (for example, tetramethylenediisocyanate, hexamethylenediisocyanate, and 2,6-diisocyanatomethyl caproate); alicyclic polyisocyanates (for example, isophoronediisocyanate and cyclohexylmethanediisocyanate); aromatic diisocyanates (for example, tolylene diisocyanate and diphenylmethanediisocyanate); aromatic aliphatic diisocyanates (for example, α,α,α',α'-tetramethylxylylenediisocyanate); isocyanurates; compounds by blocking the above polyisocyanates with, for example, a phenol derivative, oxime, or caprolactam; and combinations of two or more of these compounds.

An example of the epoxidizing agent is epichlorohydrin.

The ratio of the isocyanating agent is as follows: the equivalent ratio [NCO]/[OH] of an isocyanate group [NCO] to a polyester hydroxyl group [OH] used as a base is usually 5/1 to 1/1, preferably 4/1 to 1.2/1, and more preferably 2.5/1 to 1.5/1. When the ratio [NCO]/[OH] is excessively large, low-temperature fixability tends to deteriorate. When the molar ratio of [NCO] is too small, the content of urea in this polyester prepolymer is so small that the hot offset resistance may deteriorate.

The content of the isocyanating agent in this polyester prepolymer is from 0.5% by mass to 40% by mass, preferably 1% by mass to 30% by mass, and more preferably 2% by mass to 20% by mass. A content of the isocyanating agent that is too small tends to degrade the offset resistance and make the high-temperature storage and the low-temperature fixability lose their balance. Also, when the content of the isocyanating agent is too large, the low-temperature fixability tends to deteriorate.

Also, the number of isocyanate groups contained per molecule in this polyester prepolymer is one or more, preferably 1.5 to 3, and more preferably from 1.8 to 2.5. When the number of isocyanate groups per molecule is too small, the molecular weight of the urea-modified polyester resin after the elongation reaction tends to be small, thereby degrading the hot offset resistance.

The above binder resin precursor preferably has a weight average molecular weight of $1\times10^4$ to $3\times10^5$.

Compounds that Elongate or Cross-Link with Binder Resin Precursor

Compounds that elongate or cross-link with the binder resin precursor contain, for example, an active hydrogen group and an example thereof is an amine.

Specific examples of the amines include, but are not limited to, diamine compounds, tri- or more polyvalent polyamine compounds, amino alcohol compounds, amino mercaptan compounds, amino acid compounds, and, compounds by blocking these amino groups.

Specific examples of the diamine compounds include, but are not limited to, aromatic diamines (for example, phenylenediamine, diethyltoluenediamine, and 4,4'diaminodiphenylmethane); alicyclic diamines (for example, 4,4'-diamino-3,3'dimethyldicyclohexylmethane, diaminecyclohexane, and isophoronediamine); and aliphatic diamines (for example, ethylenediamine, tetramethylenediamine, and hexamethylenediamine).

Specific examples of the tri- or more polyvalent polyamine compounds include, but are not limited to, diethylenetriamine and triethylenetetramine.

Specific examples of the amino alcohol compounds include, but are not limited to, ethanolamine and hydroxyethylaniline.

Specific examples of the aminomercaptan compounds include, but are not limited to, aminoethylmercaptan and aminopropylmercaptan.

Specific examples of the amino acid compounds include, but are not limited to, aminopropionic acid and aminocaproic acid.

Specific Examples of the compounds obtained by blocking these amino groups include, but are not limited to, ketimine compounds and oxazoline compounds which are obtained from the above amines and ketones (for example, acetone, methyl ethyl ketone, and methyl isobutyl ketone). Preferable examples among these amines are diamine compounds and mixtures of diamine compounds and a small amount of polyamine compounds.

In the present disclosure, a non-crystalline and unmodified polyester resin can be used as the binder resin component.

It is preferable that at least a part of the modified polyester resin obtained by a cross-linking reaction or elongation reaction of the binder resin precursor made from a modified polyester resin and the unmodified polyester resin is compatible. This is advantageous to improve low-temperature fixability and hot offset resistance.

For this reason, it is preferable that the polyols and polycarboxylic acids of the modified polyester resin and unmodified polyester resin have similar compositions.

The toner of the present disclosure optionally contains dispersed binder resin. Since the crystalline polyester has crystallinity, it exhibits such heat melt properties that it is sharply reduced in viscosity at temperatures close to its endothermic peak temperature. Namely, during fixing, the crystalline polyester maintains good high-temperature storage due to crystallinity just below the melt starting temperature and the viscosity thereof sharply drops (sharp melt properties) at the melt starting temperature, so that a toner having both good high-temperature storage and low fixability can be designed.

Also, in the toner of the present disclosure, the polyester resin preferably contains a crystalline polyester which has at least a urethane/urea-modified portion and a melting point of from 60° C. to 110° C.

When a crystalline polyester having a sharp endothermic curve and an endothermic peak in a temperature range from 60° C. to 110° C. is used, it is possible to improve both the low-temperature fixability and high-temperature storage of the toner. It is more preferable when the endothermic peak temperature is 65° C. to 75° C.

It is preferable to synthesize the crystalline polyester by using a saturated aliphatic diol compound having 2 to 12 carbon atoms, and particularly, 1,4-butanediol, 1,6-hexanediol, 1,8-octanediol, 1,10-decanediol, 1,12-dodecanediol, and their derivatives as an alcohol component and a dicarboxylic acid having a double bond (C═C bond) and 2 to 12 carbon atoms or a saturated dicarboxylic acid having 2 to 12 carbon atoms and particularly fumaric acid, 1,4-butanedioic acid, 1,6-hexanedioic acid, 1,8-octanedioic acid, 1,10-decanedioic acid, 1,12-dodecanedioic acid, and their derivatives as at least an acid component.

In particular, the crystalline polyester resin is preferably constituted of only one alcohol component selected from 1,4-butanediol, 1,6-hexanediol, 1,8-octanediol, 1,10-decanediol, and 1,12-dodecanediol and only one dicarboxylic acid component selected from fumaric acid, 1,4-butanedioic acid, 1,6-hexanedioic acid, 1,8-octanedioic acid, 1,10-decanedioic acid, and 1,12-dodecanedioic acid in terms of reducing the difference between the endothermic peak temperature and the endothermic shoulder temperature.

Organic Solvent

In the present disclosure, there is no specific limit to the organic solvent and any organic solvent is usable which dissolves and/or disperses the toner composition (for example, a functional group-containing polyester resin, active hydrogen-containing compound, colorants, and nonreactive polyester resin). Preferably, the organic solvent is volatile and has a boiling point of less than 150° C. because it is easily removable.

As the organic solvents, toluene, xylene, benzene, carbon tetrachloride, methylene chloride, 1,2-dichloroethane, 1,1,2-trichloroethane, trichloroethylene, chloroform, monochlorobenzene, methyl acetate, ethyl acetate, methyl ethyl ketone, acetone, tetrahydrofuran, and the like are usable singly or in combination.

Among these examples, methyl acetate and ethyl acetate are preferable because they are highly volatile from, in particular, the toner.

The amount of the organic solvent to be used is usually 40 to 300 parts by weight, preferably 60 parts by weight to 140 parts by weight, and more preferably 80 parts by weight to 120 parts by weight based on 100 parts by weight of the toner composition.

Releasing Agent

The releasing agent in the toner of the present disclosure is coated with a white pigment. The following organic low-molecular material can be preferably used as the releasing agent. An organic low-molecular weight material having an acid value of 1.0 mg KOH to 6.0 mg KOH is preferable as the releasing agent.

Organic Low-Molecular Material

Organic low-molecular weight materials are dispersed and added to the binder resin and the colorant to impart various features when preparing the toner. Specific examples of the organic low-molecular materials include, but are not limited to, fatty acid esters, esters of aromatic acids such as phthalic acid, phosphate, maleate, fumarate, itaconate, other esters, benzyl, benzoin compounds, ketones such as benzoyl compounds, hindered phenol compounds, benzotriazole compounds, aromatic sulfonamide compounds, aliphatic amide compounds, long-chain alcohols, long-chain dialcohols, long-chain carboxylic acids, and long-chain dicarboxylic acids.

Specific examples of these organic low-molecular materials include, but are not limited to, dimethyl fumarate, monoethyl fumarate, monobutyl fumarate, monomethyl itaconate, monobutyl itaconate, diphenyl adipate, dibenzyl terephthalate, dibenzyl isophthalate, benzyl, benzoin isopropyl ether, 4-benzoylbiphenyl, 4-benzoyl diphenyl ether, 2-benzoylnaphthalene, dibenzoylmethane, 4-biphenylcarboxylic acid, stearylstearic acid amide, oleylstearic acid amide, stealin oleic acid amide, octadecanol, n-octyl alcohol, tetracosanoic acid, eicosanoic acid, stearic acid, lauric acid, nonadecanoic acid, palmitic acid, hydroxy octanoic acid, docosanoic acid, and compounds represented by the formulae (1) to (17) disclosed in JP-2002-105414-A.

Specific examples of the organic low-molecular materials include, but are not limited to, natural waxes, for example, vegetable waxes such as carnauba wax, cotton wax, tallow, and rice wax; animal waxes such as beeswax and lanolin; mineral waxes such as ozokerite and selsyn; and petroleum waxes such as paraffin wax, microcrystalline wax, and petrolatum. Examples of the organic low-molecular material also include, besides these natural waxes, synthetic hydrocarbon waxes such as Fisher-Tropsch wax and polyethylene wax; and synthetic waxes such as esters, ketones, and ethers. Moreover, fatty acid amides such as 12-hydroxystearic acid amide, stearic acid amide, phthalic acid imide anhydride, and chlorinated hydrocarbons; low-molecular crystalline polymer resins, for example, homopolymers and copolymers of polyacrylates such as a poly-n-stearylmethacrylate and poly-n-laurylmethacrylate (for example, a copolymer of n-stearylacrylate ethylmethacrylate); and crystalline polymers having a long alkyl group on the side chain are also usable.

These compounds can be used alone or in combination.

The resin used in the present disclosure is incompatible with the organic low-molecular material, and the organic low-molecular material serves as a releasing agent. The melt temperature of the organic low-molecular material is preferably from 100° C. or less and more preferably 90° C. or less. When the melt temperature is 100° C. or more, this tends to cause cold offset in the fixing.

The melt viscosity of the organic low-molecular material is preferably 5 cps to 1,000 cps and more preferably from 10 cps to 100 cps as a value measured at a temperature 10° C. higher than the melting point of the organic low-molecular material.

When the melt viscosity is too small, the releasability easily deteriorates. When the melt viscosity is too large, the hot offset resistance and low-temperature fixability tend to be not improved.

When the resin and the organic low-molecular material are compatible with each other at a temperature equal to or higher than the melting temperature of the organic low-molecular material, the organic low-molecular material serves as a plasticizer. Specifically, the organic low-molecular material improves the softening speed of the resin, thereby imparting low-temperature fixability.

In the case of the present disclosure, it is undesirable that the resin be compatible with the organic low-molecular material at temperatures equal to or higher than the melting temperature of the organic low-molecular material. This is because there is a concern that both are mutually dissolved in each other in the production of the toner, which impairs the high-temperature storage of the toner.

Each of the resin and organic low-molecular material preferably has an acid value of 1.0 mg KOH/g to 6.0 mg KOH/g. When the acid value is too low, the resin and organic low-molecular material are easily dispersed singly without encapsulating the white pigment mentioned above. Also, when the acid value is too large, the compatibility between the organic low-molecular material and the binder resin is improved, thereby failing to serve as a releasing agent.

Other Materials

As materials other than the white pigment, the binder resin, and the organic low-molecular material, inorganic particulates are usable as an external additive to impart fluidity, developing ability, electrification characteristics, cleaning ability, and the like to the toner particles.

There is no specific limit to the inorganic particulates used as the external additives. Any known material is selectable. Specific examples of the inorganic particulates include, but are not limited to, silica, alumina, titanium oxide, barium titanate, magnesium titanate, calcium titanate, strontium titanate, zinc oxide, tin oxide, silica sand, clay, mica, wollastonite, diatomaceous earth, chromium oxide, cerium oxide, red iron oxide, antimony trioxide, magnesium oxide, zirconium oxide, barium sulfate, barium carbonate, calcium carbonate, silicon carbide, and silicon nitride. These compounds can be used alone or in combination.

The primary particle diameter of the inorganic particulates is preferably from 5 nm to 2 μm and more preferably from 5 nm to 500 nm. Also, the specific surface area of the inorganic particulates as measured by the BET method is preferably from 20 $m^2/g$ to 500 $m^2/g$.

The content of the inorganic particulates in the toner is preferably from 0.01% by mass to 5.0% by mass and more preferably from 0.01% by mass to 2.0% by mass.

When the inorganic particulates are used as an external additive to improve, for example, the fluidity of the toner, such inorganic particulates are preferably surface-treated with a fluidity improver.

The fluidity improver improves the hydrophobicity of particles due to surface-treatment, thereby preventing the particles from deteriorating in fluidity and chargeability even in humid circumstances. Specific examples of the fluidity improver include, but are not limited to, a silane coupling agent, silylating agent, silane coupling agent having a fluorinated alkyl group, organic titanate type coupling agent, aluminum type coupling agent, silicone oil, and modified silicone oil. It is particularly preferable to use a hydrophobic silica or hydrophobic titanium oxide prepared by surface-treating the above-specified silica and titanium oxide with such a fluidity improver.

A cleaning improver that improves the cleanability of the toner is added to the toner to remove an un-transferred development agent remaining on a photoreceptor and a primary transfer medium. Specific examples of the cleaning improver include, but are not limited to, zinc stearate, calcium stearate, metal salts of fatty acids such as stearic acid, and polymer particulates produced by soap-free emulsion polymerization such as polymethylmethacrylate particulates and polystyrene particulates. Preferably, the polymer particulates have a relatively narrow particle size distribution and a volume average particle diameter of from 0.01 μm to 1 μm.

There is no specific limit to the selection of the charge control agent. Any known charge control agents is usable. Specific examples of the charge control agent include, but are not limited to, a nigrosine type dye, triphenylmethane type dye, chromium-containing metal complex dye, molybdic acid chelate pigment, rhodamine type dye, alkoxy type amine, quaternary ammonium salts (including a fluorine-modified quaternary ammonium salt), alkylamide, single phosphorus or its compounds, single tungsten or its compounds, fluorine type activating agent, metal salts of salicylic acid, and metal salts of salicylic acid derivatives. These compounds can be used alone or in combination.

Products available from the market can be used as the charge control agent. Specific examples of these products include, but are not limited to, BONTRON 03, which is a nigrosine type dye, BONTRON P-51, which is a quaternary ammonium salt, BONTRON S-34, which is a metal-containing azo dye, E-82, which is an oxynaphthoic acid type metal complex, E-84, which is a salicylic acid type metal complex, and E-89, which is a phenol type condensate (all of these products are manufactured by Orient Chemical Industries Co., Ltd.), TP-302 and TP-415, which are quaternary ammonium salt molybdenum complexes (all of these products are manufactured by Hodogaya Chemical Co., Ltd.), Copy Charge PSY VP2038 of a quaternary ammonium salt, Copy Blue PR of a triphenylmethane derivative, Copy Charge NEG VP2036 of a quaternary ammonium salt, Copy Charge NX VP434 (all of these products are manufactured by Hoechst AG), LRA-901, LR-147 which is a boron complex (manufactured by Japan Carlit Co., Ltd.), copper phthalocyanine, perylene, quinacridone, azo type pigments, and other polymer type compounds having a functional group such as sulfonic acid group, carboxyl group, or quaternary ammonium salt.

Although it is not possible to jump to any unambiguous conclusion, the content of the charge control agent in the toner is, for example, preferably from 0.1 parts to 10 parts by weight and more preferably from 0.2 parts by weight to 5 parts by weight based on 100 parts by weight. This is because the content differs depending on the type of resin, presence of additives, dispersing method, and the like. When the content of the charge control agent is too small, the charge control is not easily obtained. When the content is too large, the chargeability of the toner tends to be excessively large, which may beyond the control ability of the major charge control agent, leading to increase in electrostatic attraction force between the toner and the developing roller, resulting in degradation of fluidity of the development agent or decrease in image density.

Development Agent

The white toner of the present disclosure for use in electrostatic image development can be used as a one-component development agent or two-component development agent.

When the toner of the present disclosure is used as a two-component development agent, the white toner can be mixed with a toner carrier made of magnetic particles (hereinafter also referred to as a carrier or a magnetic carrier). The ratio of the contents of the toner to the carrier in the development agent is preferably from 1 part by weight to 10 parts by weight of the toner to 100 parts by weight of the carrier.

Any known carrier can be used, which is, for example, iron powder, ferrite powder, magnetite powder, and magnetic resin carrier each having a particle diameter of from about 20 μm to about 200 μm.

Specific examples of coating materials for the magnetic carriers include, but are not limited to, amino type resins, for example, a urea-formaldehyde resin, melamine resin, benzoguanamine resin, urea resin, polyamide resin, and epoxy resin. Also, copolymers of polyvinyl or polyvinylidene resins, for example, an acryl resin, polymethylmethacrylate resin, polyacrylonitrile resin, polyvinyl acetate resin, polyvinyl alcohol resin, polyvinylbutyral resin, polystyrene type resins such as a polystyrene resin and styrene acryl copolymer resin, olefin halide resins such as a polyvinyl chloride, polyester type resins such as a polyethylene terephthalate resin and polybutylene terephthalate resin, polycarbonate type resins, polyethylene resin, polyvinyl fluoride resin, polyvinylidene fluoride resin, polytrifluoroethylene resin, polyhexafluoropropylene resin, copolymers of vinylidene fluoride and an acryl monomer, copolymers of vinylidene fluoride and vinyl fluoride, fluoro terpolymers such as a terpolymer of tetrafluoroethylene, vinylidene fluoride, and non-fluorinated monomer, and silicone resin may be used.

The coating resin optionally contains electroconductive powder. Metal powder, carbon black, titanium oxide, tin oxide, zinc oxide, or the like can be used as the electroconductive powder. These electroconductive powders preferably have an average particle diameter of 1 μm or less. When the average particle diameter is too large, it tend to be difficult to control the electric resistance.

As described above, the toner of the present disclosure can be used as a one-component development agent (magnetic toner or nonmagnetic toner) without a carrier.

Printed Matter

The printed matter of the present disclosure has at least a substrate on which an image is formed, a color image layer, and a white image layer formed using the white toner.

Specifically, a full-color chromatic image layer on a substrate formed of, for example, a transparent film is formed by electrophotography using yellow toner, cyan toner, magenta toner, and black toner. Thereafter, a solid white image layer (masking layer) is formed on the chromatic image layer by the white toner, followed by fixing to obtain a fixed printed matter. When this image is viewed from back, i.e., the substrate side, the image look highly glossy and high class. That is, since the surface of the transparent film is smooth, the image look very highly glossy regardless of the amount of the toner stuck. Moreover, the surface of this image is so smooth that external light (illumination light and natural light) reflected from the surface does not diffuse. As a consequence, the obtained image is very highly chromatic and high class to human eyes.

Also, a solid white image layer is formed on a transparent film or the like serving as a substrate by using the white toner followed by forming a full-color chromatic image layer on the reverse side of the white image layer by using yellow toner, cyan toner, magenta toner, and black toner to obtain a fixed printed matter.

In this manner, a vivid and clear printed matter having good color is obtained by printing a full-color image on a smoother substrate.

Also, a solid white image layer can be formed on at least a part of a transparent, black, or colored substrate (e.g., film or paper) followed by forming a full-color chromatic image layer on the white image layer to obtain a fixed printed matter. When a solid white image layer is formed on a substrate by using the white toner in this manner, the white image layer serves as a masking layer so that a full-color chromatic image can be produced irrespective of the color of the substrate.

Recording Medium

A recording medium for use in the present disclosure has a white image layer formed of the white toner on at least one surface of a substrate.

Namely, it is possible to apply the white toner to a transparent, black, or colored substrate (e.g., film or paper) to form a white image layer serving as a white background (masking layer) in addition to forming a white background to view a full color chromatic image formed on a transparent film or the like serving as the substrate by using yellow toner, cyan toner, magenta toner, and black toner from the reverse side of the image.

In this case, a full-color image can be formed on the white background of a recording medium in which a white background base (masking layer) is formed on at least a part of one surface of the transparent, black, or colored substrate (e.g., film or paper) to obtain a printed matter after fixing.

Also, in the case of a recording medium on which a white background base (masking layer) is formed on at least a part of one surface of a transparent film by using the white toner, it is possible to produce a printed matter by forming and fixing a full color chromatic image formed by using yellow toner, cyan toner, magenta toner, and black toner on the transparent film on the reverse side of the white background base.

When the white toner is used to form a solid background image or white background base, the coating amount of the white toner preferably ranges from 0.5 $mg/cm^2$ or more to demonstrate sufficient masking to 3 $mg/cm^2$ or less taking into account the cracking of the toner layer.

In the present disclosure, in addition to the white toner, color toners and black toner are used in combination. Any known color or black toner for use in elelctrophotography can be used.

Although there is no specific limit to the weight average particle diameters of these color toners and black toner, it is preferably from 2 μm to 15 μm. To output high quality images, the highly precise pulverization method and polymerization method can be used.

Any known material or combination thereof is used as the raw material constituting the white toner as long as the properties of the produced toner satisfy the requirements described in the present disclosure.

Method of Producing Toner

The method of producing toner of the present disclosure includes granulating at least a binder resin, titanium dioxide as a white pigment, and an organic low-molecular weight material having an acid value of from 1.0 mg KOH/g to 6.0 mg KOH/g as a releasing agent through at least the following step A or B.

Step A: Melt-kneading these materials in a temperature condition under which the releasing agent is melted to form a kneaded material followed by grinding and classification thereof, or (B): Mixing and dispersing the binder resin, the white pigment, and the releasing agent in the temperature condition to prepare a toner composition solution followed by dispersion and emulsification of the toner composition solution in an aqueous medium phase in the temperature condition.

That is, the toner can be manufactured by the conventional method such as the pulverization method in which a melt-kneaded toner material bulk is physically pulverized or the chemical method of emulsifying or dispersing in an aqueous medium a toner composition solution in which toner materials are dissolved and suspended in an organic solvent.

Basically, the white pigment, the binder resin, and the releasing agent, which are the toner materials, are mixed followed by melting the releasing agent to granulate the toner.

The releasing agent gathers on the surface of the white pigment in the process of melting in the mixture state so that the white pigment is present in the granulated mother toner particle while it is covered with the releasing agent.

Unless the releasing agent is melted, the white pigment and the releasing agent are separately present in the toner so that the impact of the white pigment on the binder resin reflects on the toner properties, resulting in, in particular, deterioration of the low temperature fixability and the durability, which leads to image cracking.

When manufacturing the toner by the pulverization method, it is preferable to produce the toner through the melt-kneading process at a temperature at which the releasing agent is melted to obtain a kneaded material followed by the processes of pulverizing and classifying the kneaded material.

Also, in the chemical method of emulsifying or dispersing in an aqueous medium a toner component solution in which toner materials are dissolved and suspended in an organic solvent, it is preferable to dissolve and suspend the binder resin, the white pigment, and the releasing agent in an organic solvent at temperatures at which the releasing agent is melted. Moreover, it is preferable to produce toner through a process of dispersing and emulsifying the thus-obtained toner composition solution under the same temperature condition as mentioned above in an aqueous medium phase in which resin particulates are dispersed.

Image Forming Method

Next, an image forming method using the white toner of the present disclosure is described.

The image forming method using the white toner of the present disclosure includes, for example, forming a full color chromatic image layer of yellow toner, magenta toner, cyan toner, and black toner on a transparent film serving as a substrate by electrophotography and forming a solid white image layer (masking layer) on the full color image by the white toner of the present disclosure to view the image from back, i.e., the reverse side of the image.

Also, a printed matter can be obtained by forming a solid image of the white toner on a transparent film first followed by forming a chromatic image thereon. Moreover, it is possible to form a full-color chromatic image on one side of a substrate and an image layer of the white toner on the other side.

The full-color chromatic image layer is formed by using a full-color image forming apparatus which conducts at least an electrostatic image forming step, a developing step, a transfer step, a fixing step, and a cleaning step and other optional steps such as a discharging step, a recycling step, and a control step using each toner of yellow, magenta, cyan, and black.

Next, a white toner image layer (masking layer) is formed on the entire surface of the transparent film on which the full-color image is formed using the white toner of the present disclosure by a separate image forming apparatus.

When an image formed on a transfer belt is transferred to a transparent film, for example, an image forming apparatus having development units for five color toners as described later forms a solid image of the white toner on a transfer belt first and thereafter a full color image of black, cyan, magenta, and yellow on the solid image followed by transferring the thus-obtained image to a transfer film from the image side.

By forming an image in such a manner, it is possible to view a highly contrasty full-color image from the reverse side thereof.

Forming images in an embodiment of the present disclosure is described with reference to the image forming apparatus of FIG. 3. An image forming apparatus 100 shown in FIG. 3 has a drum photoreceptor 10 serving as an image bearing member, a charge roller 20 serving as a charging device, beams of light 30 by an irradiator serving as an exposure device, a developing device 40 serving as a developing device, an intermediate transfer element 50, a cleaning blade 60 serving as a cleaning device, and a discharging lamp 70 serving as a discharging device.

Figure 3:
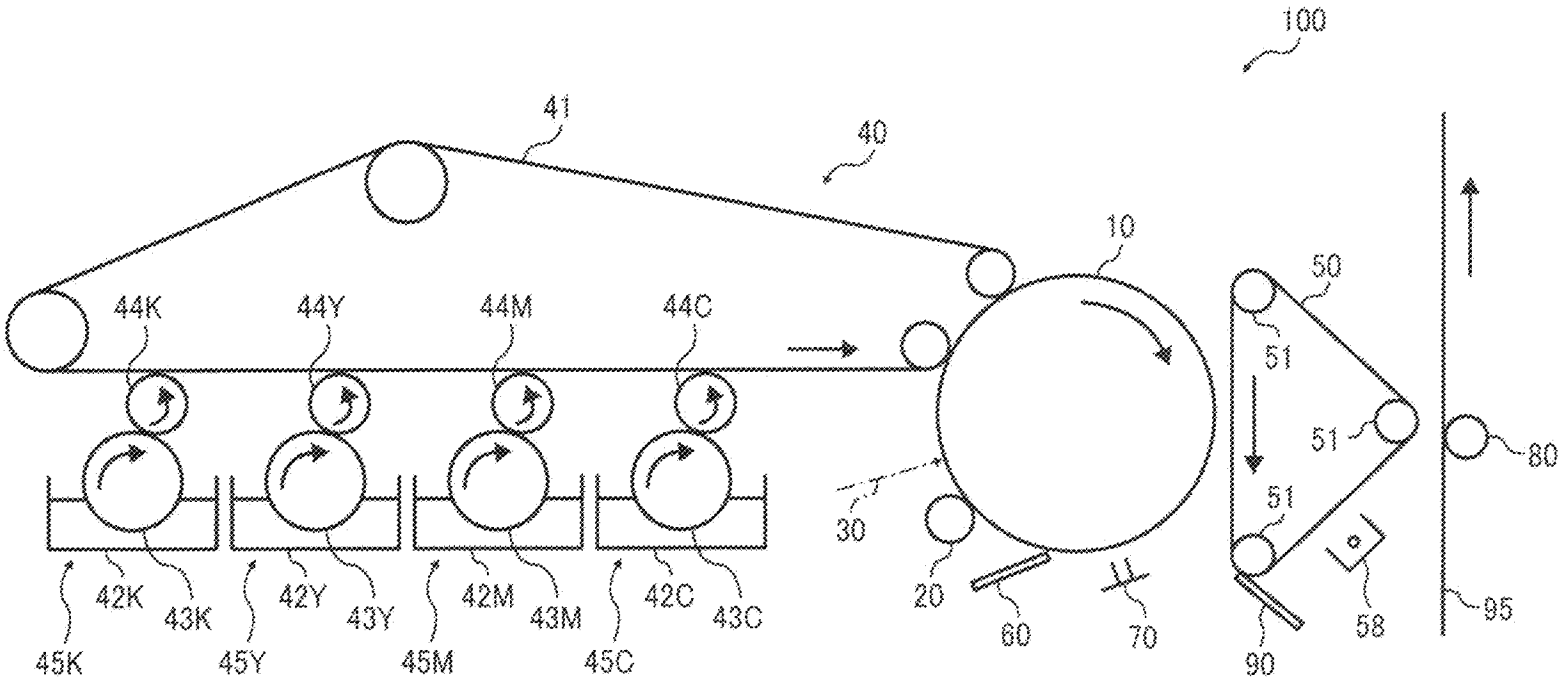
FIG. 3 is a schematic diagram illustrating an example of the image forming apparatus according to an embodiment of the present invention.

The intermediate transfer element 50 is an endless belt and designed to move in the direction indicated by an arrow in FIG. 3 by three rollers 51 arranged inside of the intermediate transfer element 50 to stretch the belt. It is possible to use at least one of these three rollers 51 as a transfer bias roller capable of applying a predetermined transfer bias (primary transfer bias) to the intermediate transfer element 50. Around the intermediate transfer element 50, there is arranged a cleaning blade 90, a transfer roller 80, and a corona charger 58. The transfer roller 80 serves as the transfer device and is provided facing the intermediate transfer element 50 to apply a transfer bias to secondarily transfer the visible image (toner image) to a recording medium 95. The corona charger 58 is provided upstream of the portion where the drum photoreceptor 10 contacts the intermediate transfer element 50 and downstream of the portion where the intermediate transfer element 50 contacts the recording medium 95 in the moving direction of the intermediate transfer element 50 to impart charge to the toner image on the intermediate transfer element 50.

The developing unit 40 has a developing belt 41 serving as a development agent bearing member, a black developing unit 45K, a yellow developing unit 45Y, a magenta developing unit 45M, and a cyan developing unit 45C each of which is arranged around the developing belt 41. The black developing unit 45K has a development agent accommodating unit 42K, a development agent supply roller 43K, and a developing roller 44K. The yellow developing unit 45Y has a development agent accommodating unit 42Y, a development agent supply roller 43Y, and a developing roller 44Y. The magenta developing unit 45M has a development agent accommodating unit 42M, a development agent supply roller 43M, and a developing roller 44M. The cyan developing unit 45C has a development agent accommodating unit 42C, a development agent supply roller 43C, and a developing roller 44C. Also, the developing belt 41 is an endless belt stretched in a rotatable manner by a plurality of belt rollers. Part of the developing belt is brought into contact with the drum photoreceptor 10.

In the image forming apparatus 100 illustrated in FIG. 3, for example, a charge roller 20 uniformly charges the drum photoreceptor 10. The exposure device irradiates the drum photoreceptor 10 with beans of light 30 according to obtained image data to form a latent electrostatic image. The latent electrostatic image formed on the drum photoreceptor 10 is developed by supplying toner from the developing device 40 to form a toner image. The toner image is transferred (primary transfer) to the intermediate transfer element 50 by the voltage applied from the roller 51 and is further transferred (secondary transfer) to the surface of the recording medium 95. As a result, a transfer image is formed on the recording medium 95. Residual toner on the drum photoreceptor 10 is removed by the cleaning blade 60 and the electric charges of the drum photoreceptor 10 are removed once by the discharging lamp 70.

Figure 4:
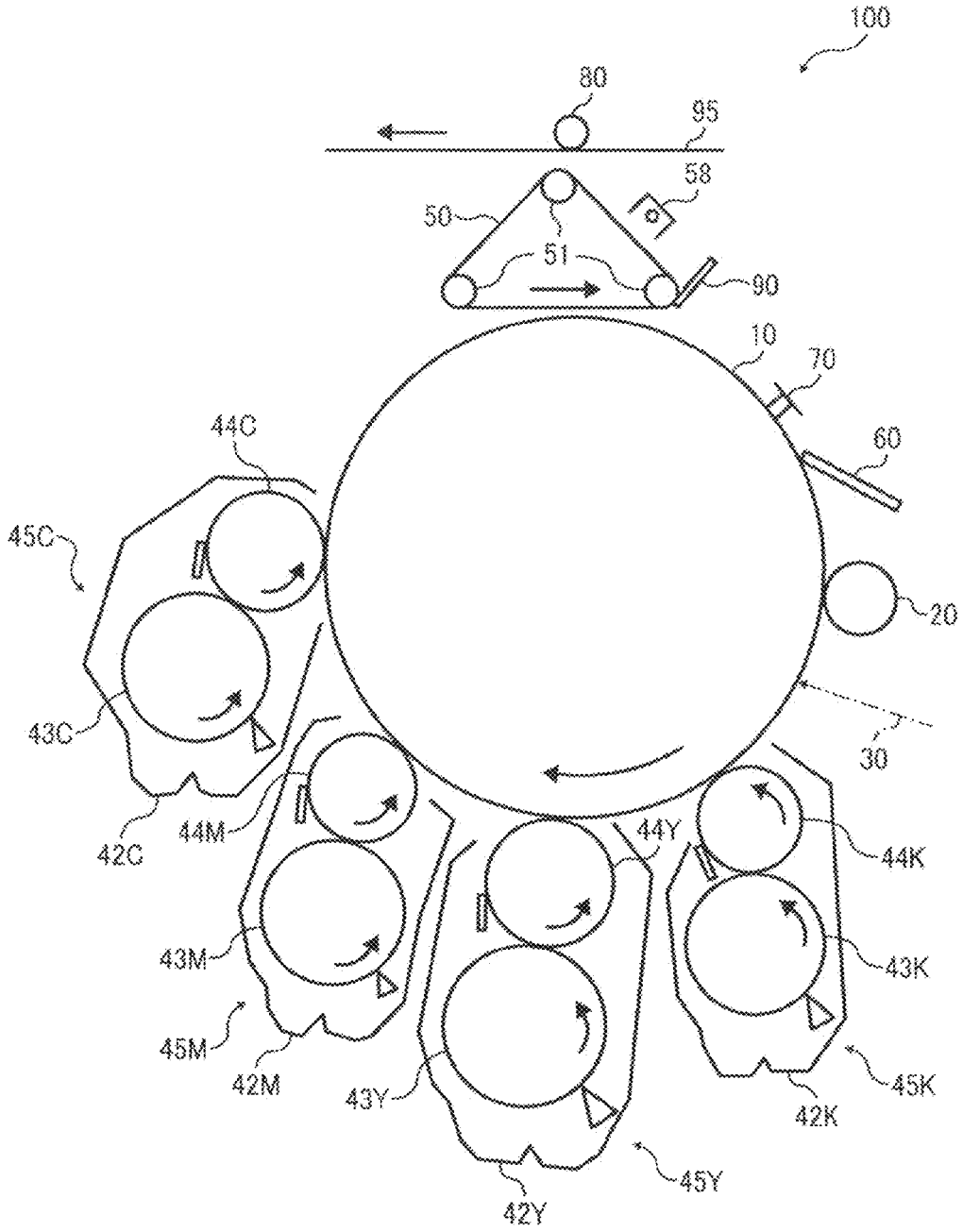
FIG. 4 is a schematic structural view illustrating another example of an image forming apparatus according to an embodiment of the present invention.

Another embodiment for conducting the image forming method of the present disclosure is described with reference to the image forming apparatus of FIG. 4. An image forming apparatus 100 illustrated in FIG. 4 has the same configuration as the image forming apparatus 100 illustrated in FIG. 3 except that the image forming apparatus 100 illustrated in FIG. 4 has no developing belt 41 serving as the development agent bearing member and the black developing unit 45K, yellow developing unit 45Y, magenta developing unit 45M, and cyan developing unit 45C are disposed directly facing the drum photoreceptor 10. In FIG. 4, the same parts as those in FIG. 3 are represented by the same reference numerals.

Figure 5:
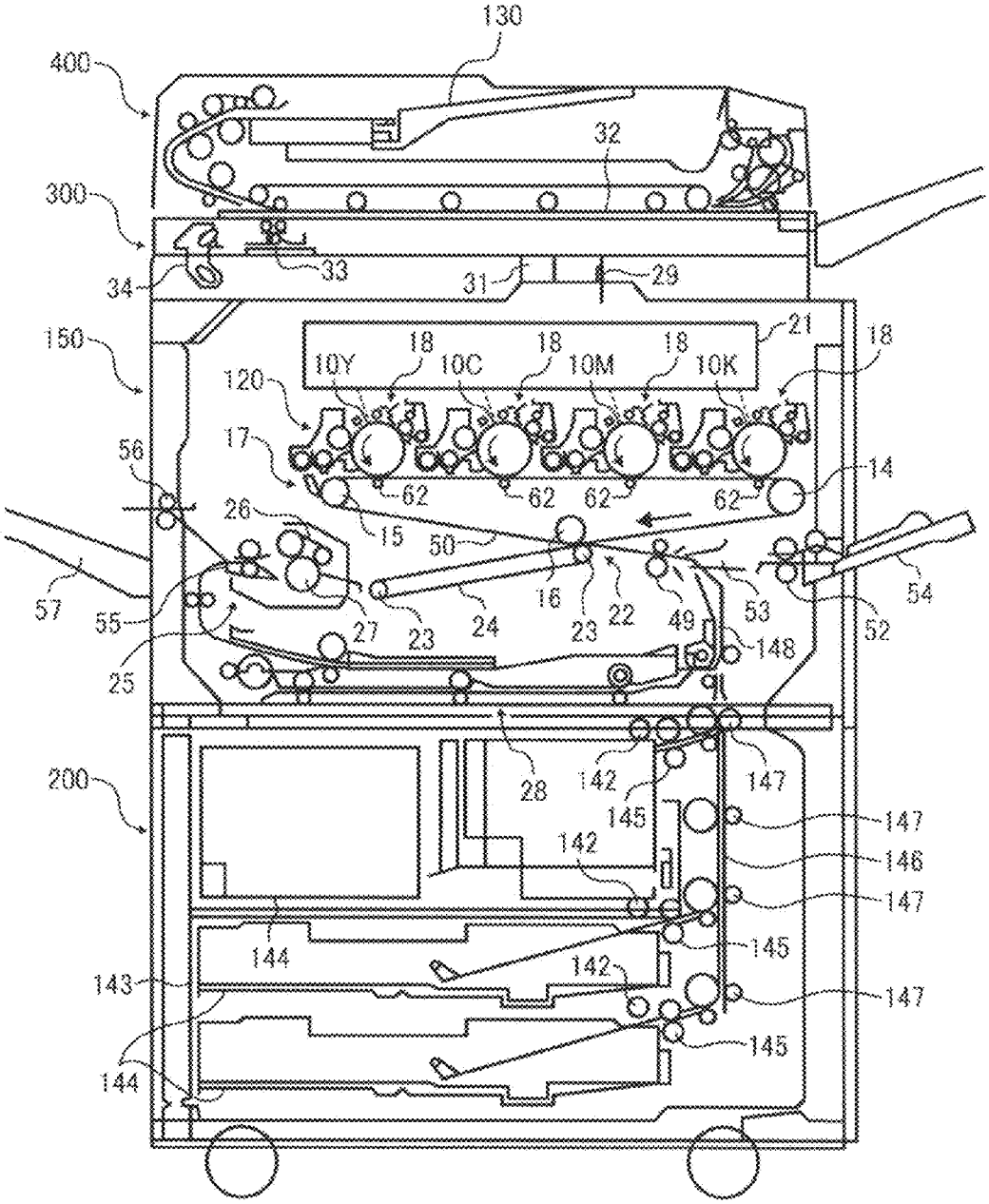
FIG. 5 is a schematic structural view illustrating another example of an image forming apparatus according to an embodiment of the present invention.

Another embodiment of conducting the image forming method of the present disclosure is described with reference to FIG. 5. A tandem image forming apparatus 100 illustrated in FIG. 5 is a tandem type color image forming apparatus. The tandem image forming apparatus 100 has a main part 150, a paper feeding table 200, a scanner 300, and an automatic document feeder (ADF) 400.

The main part 150 has an intermediate transfer element 50 having an endless belt form disposed in the center thereof. The intermediate transfer element 50 is stretched by support rollers 14, 15, and 16 and designed to rotate clockwise in FIG. 5. An intermediate transfer cleaning device 17 is disposed in the vicinity of the support roller 15 to remove residual toner left on the intermediate transfer element 50. A tandem type developing unit 120 is provided which includes four (yellow, cyan, magenta, and black) image forming units 18 arranged side by side along the portion of the intermediate transfer element 50 which is stretched by the support rollers 14 and 15. An exposure device 21 is disposed in the vicinity of the tandem type developing unit 120. A secondary transfer device 22 is disposed around the intermediate transfer element 50 on the reverse side of the tandem type developing unit 120. In the secondary transfer device 22, a secondary transfer belt 24, which is an endless belt is stretched by a pair of rollers 23 and conveys the recording medium, so that the recording medium can contact the intermediate transfer element 50. A fixing device 25 is disposed in the vicinity of the secondary transfer device 22.

In the tandem image forming apparatus 100, a reversing unit 28 that changes the moving direction of the recording medium to form an image on each side of the recording medium is arranged in the vicinity of the secondary transfer device 22 and a fixing device 25.

Next, the formation of a full-color image by using the tandem type developing unit 120 is described. Specifically, an original document is set on the surface of a document holder 130 of the automatic document feeder (ADF) 400 or the automatic document feeder 400 is opened to set an original document on the surface of a contact glass 32 and then closed.

When a start switch is pressed, a scanner 300 is driven after the original document is conveyed and transferred to the surface of the contact glass 32 when the original document is set on the surface of the automatic document feeder 400 or instantly when the original document is set on the surface of the contact glass 32, to move a first carrier 33 and a second carrier 34. At this time, the first carrier 33 reflects light from a light source and the reflection from the original document is further reflected at the mirror of the second carrier 34. The reflection at the mirror of the second carrier 34 is received at a reading sensor 29 to read a color image (document), which is stored as image information of black, yellow, magenta, and cyan. The numeral references 31 represents a focusing lens.

Figure 6:
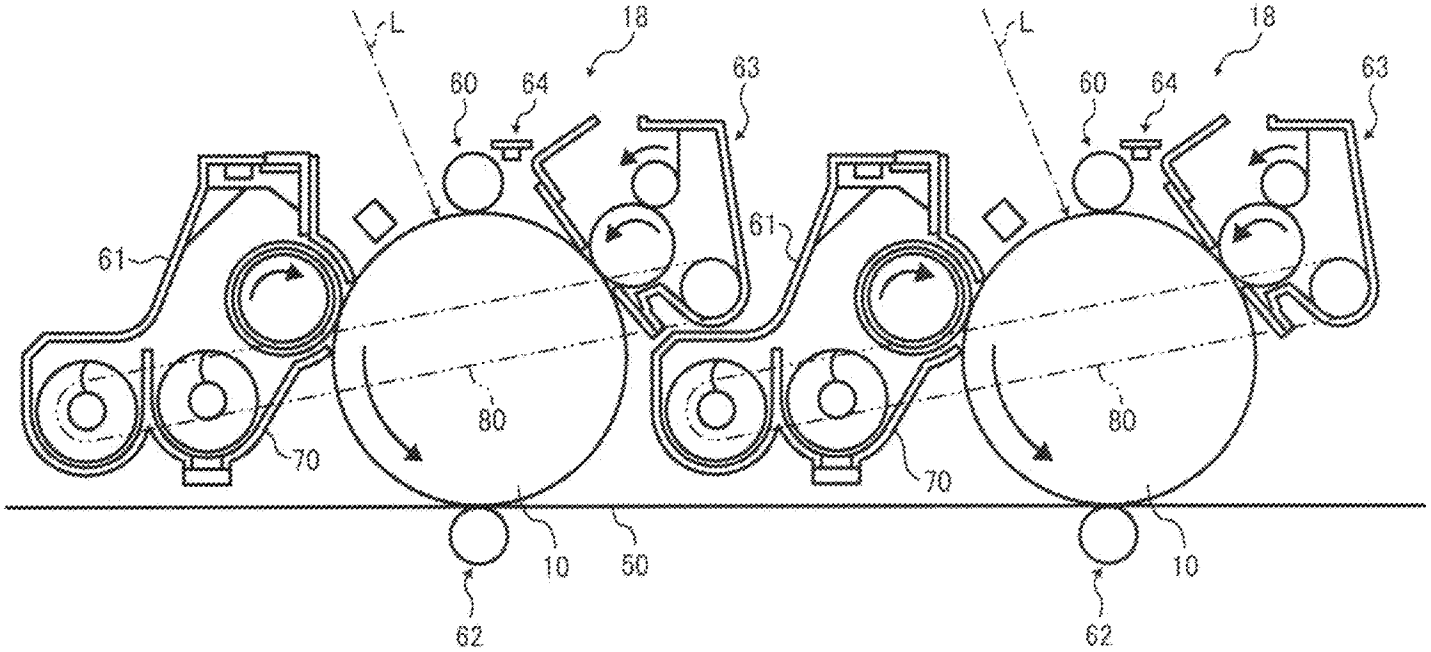
FIG. 6 is an enlarged view illustrating part of FIG. 5.

Then, each image information of black, yellow, magenta, and cyan is transmitted to corresponding image forming units 18 (black image forming unit, yellow image forming unit, magenta image forming unit, and cyan image forming unit) in the tandem type developing unit 120 to form each toner image of black, yellow, magenta, and cyan in each image forming unit. Specifically, as illustrated in FIG. 6, each image forming unit 18 (black image forming unit, yellow image forming unit, magenta image forming unit, and cyan image forming unit) in the tandem type developing unit 120 has a latent electrostatic image bearing member 10 (black latent electrostatic image bearing member 10K, yellow latent electrostatic image bearing member 10Y, magenta latent electrostatic image bearing member 10M, and cyan latent electrostatic image bearing member 10C), a charger 60 that uniformly charges the latent electrostatic bearing member 10, an irradiator that exposes the latent electrostatic image bearing member 10 with L illustrated in FIG. 6 according to the color image information to form a latent electrostatic image corresponding to each color image on the latent electrostatic image bearing member 10, a developing unit 61 that develops the latent electrostatic image by using each color toner (black toner, yellow toner, magenta toner, and cyan toner) to form a toner image of each color toner, a transfer charger 62 that transfers the toner image to the intermediate transfer element 50, a cleaning device 63, and a discharger 64, to form each single color image (black image, yellow image, magenta image, and cyan image) based on each color image formation. The black image, yellow image, magenta image, and cyan image formed in this manner, that is, the black image formed on the black latent electrostatic image carrier 10K, yellow image formed the yellow latent electrostatic image carrier 10Y, magenta image formed on the magenta latent electrostatic image bearing member 10M, and cyan image formed on the cyan latent electrostatic image bearing member 10C are transferred (primary transfer) one by one to the intermediate transfer element 50 which is rotationally transferred by the support rollers 14, 15, and 16. Then, the black image, yellow image, magenta image, and cyan image are superimposed sequentially on the intermediate transfer element 50 to form a synthetic color image (color transfer image).

In the paper feeding table 200, one of the paper feed rollers 142 is selectively rotated to draw a recording medium from one of multistage paper feed cassettes 144 provided in a paper bank 143. A separating roller 145 separates the recording media one by one by to feed each paper to a paper feed path 146. The recording medium is conveyed by a conveyer roller 147, introduced into a paper feed path 148 in the main part 150, strikes a registration roller 49, and is held there. Alternatively, the recording medium on a manual tray 54 is fed one by one by a separating roller 52, introduced into a manual paper feed path 53, strikes a registration roller 49, and is held there. Although the registration roller 49 is usually used in a grounded condition, a bias can be applied thereto to remove paper dust of the recording medium. Then, the registration roller 49 feeds the recording medium between the intermediate transfer element 50 and the secondary transfer device 22 by rotating in synchronization with the synthetic color image (color transfer image) synthesized on the intermediate transfer element 50. The secondary transfer device 22 secondarily transfers the synthetic color image (color transfer image) to the recording medium to form the color image thereon. Residual toner left on the intermediate transfer element 50 after the image transfer is removed by the intermediate transfer element cleaning device 17.

The recording medium onto which the color image is transferred is conveyed by the secondary transfer device 22 and fed to a fixing device 25 including a fixing belt 26 and pressure roller 27, where the synthetic color image (color transfer image) is fixed onto the recording medium by heat and pressure. Then, the recording medium is turned by a switching claw 55, discharged by a discharge roller 56, and stuck on a paper discharge tray 57. Alternatively, the recording medium is turned by the switching claw 55, inversed by a reversing unit 28, introduced again into the transfer position to record an image on the backside thereof, then, discharged by the discharging roller 56, and stuck on the discharging tray 57.

Figure 7:
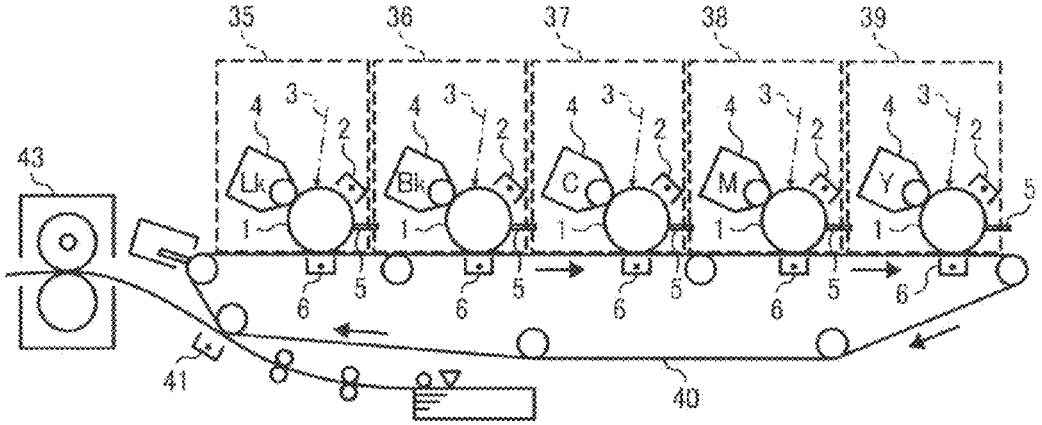
FIG. 7 is a schematic diagram illustrating an example of an image forming apparatus capable of forming both a white toner image according to an embodiment of the present invention and a full-color image.

The mechanism of forming an image of the white toner on the full color image is described next. For example, an image forming apparatus having development units for five colors is used. FIG. 7 is a schematic diagram illustrating this image forming apparatus for five colors.

A developing unit 35 uses white toner, a developing unit 36 uses black toner, a developing unit 37 uses cyan toner, a developing unit 38 uses magenta toner, and a developing unit 39 uses yellow toner to form an image in each developing unit. Each formed image is transferred to an intermediate transfer belt 40. The image on the intermediate transfer belt 40 is transferred to a transparent film or the like by a transfer device 41 and fixed by a fixing device 43. The reference numerals 1, 2, 3, 4, 5, and 6 represent a photoreceptor, a charger, a beam of light, a development unit, a cleaner, and a transfer charger, respectively.

In this case, since the white toner layer forms the uppermost layer of the image, it is possible to view the full-color image from the side on which no image is formed. However, when using black or colored substrate (typically paper), the arrangement of the developing units is required to change to form a white layer first. Accordingly, the white developing unit is moved to the position of the yellow developing unit 39 to move the other developing units to the position of the adjacent developing from right to left.

In the present disclosure, it is possible to form images not only by using an image forming apparatus having five image developing units as illustrated in FIG. 7 but also by separate image forming apparatuses including, for example, a combination of a full-color MFP available in the market to form full color images and a monochrome MFP available in the market to form white images. The MFP means a photocopier capable of faxing and printing. This combination has advantages in terms of development because existing image forming apparatuses are usable by remodeling. In addition, since white images and full color images are formed by separate apparatuses, the toners are not mingled because a white image is formed on a fixed color image. This applies to the case in which a color image is formed on a fixed white image. However, the image forming apparatus illustrated in FIG. 7 superimposes an unfixed image on an unfixed image, which possibly causes a problem during transfer and fixing. Considering the white toner in particular has an adverse impact on coloring due to its masking property, avoiding of mingling of the toners is preferable.

Process Cartridge

The image forming apparatus of the present disclosure optionally has a process cartridge which integrally supports a latent electrostatic image bearing member and a developing device which at least develops an electrostatic image formed on the image bearing member by using the white toner of the present disclosure to form a visible image. The process cartridge is detachably attachable to the image forming apparatus and optionally has other devices such as a cleaning device.

Figure 8:
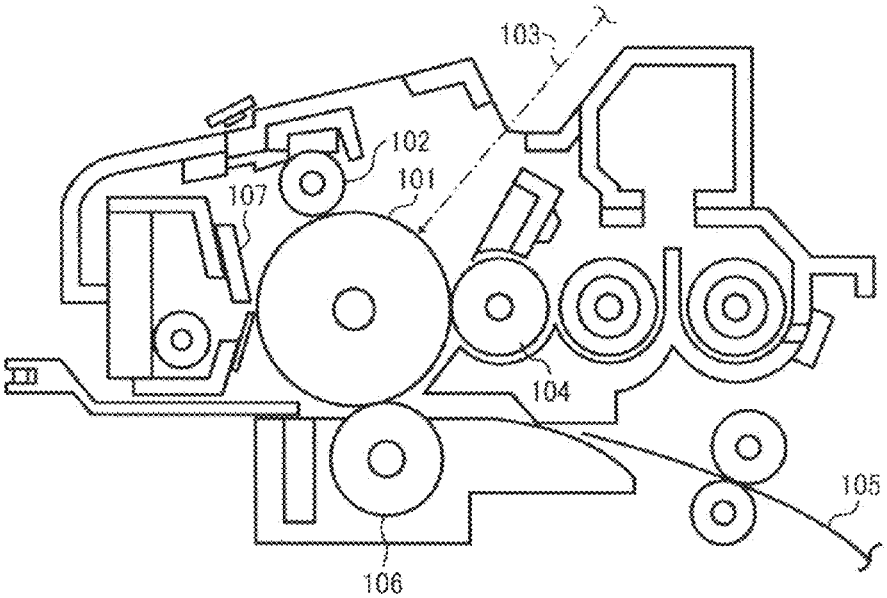
FIG. 8 is a schematic diagram illustrating an example of a process cartridge using toner according to an embodiment of the present invention.

FIG. 8 is a diagram illustrating an example of the process cartridge. This process cartridge has a built-in photoreceptor 101, a charger 102, an irradiator 103, a developing device 104, a transfer device 106, and a cleaning device 107. For these elements, the same members as those used in the image forming apparatus are usable.

Having generally described preferred embodiments of this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Manufacturing Master Batch

White Master Batch A 400 parts of Tipaque PF-739 (trade name, manufactured by Ishihara Sangyo Kaisha Ltd., a product treated by a surface treating agent containing titanium dioxide: aluminum, zirconia, and trimethylolpropane, average particle diameter: 250 nm), 200 parts of a polyester resin A (trade name: Tafton RN-263SF, manufactured by Kao Corporation, Tg: 58.5° C., main component: adduct of bisphenol A with ethylene oxide, terephthalic acid), and 30 parts of deionized water were poured into a polyethylene bag. Subsequent to mixing, the mixture was kneaded by an open roll kneader (Kneadex, manufactured by Nippon Coke & Engineering Co., Ltd.) by two passes in the following condition: temperatures at the front roll supply side and discharge side: 100° C. and 80° C., respectively; temperatures at the back roll supply side and discharge side: 30° C. and 20° C., respectively; number of rotations of the front roll: 35 rotation per minute (rpm); number of rotations of the back roll: 31 rpm; gap: 0.25 mm. Thereafter, the mixture was pulverized by a pulvelizer (manufactured by Hosokawa Micron Corporation) to prepare a white master batch A.

White Master Batch B

A white master batch B was prepared in the same manner as the white master batch A except that Tipaque CR-60-2 (manufactured by Ishihara Sangyo Kaisha Ltd., a product treated by a surface treating agent containing titanium dioxide: aluminum and trimethylolpropane, average particle diameter: 210 nm) was used in place of Tipaque PF-739 (manufactured by Ishihara Sangyo Kaisha Ltd., a product treated by a surface treating agent including titanium dioxide: aluminum, zirconia, and trimethylolpropane, average particle diameter: 250 nm).

White Master Batch C

A white master batch C was prepared in the same manner as the white master batch A except that Tipaque PF-728 (manufactured by Ishihara Sangyo Kaisha Ltd., a product treated by a surface treating agent including titanium dioxide: aluminum, silicon, and siloxane, average particle diameter: 210 nm) was used in place of Tipaque PF-739 (manufactured by Ishihara Sangyo Kaisha Ltd., a product treated by a surface treating agent including titanium dioxide: aluminum, zirconia, and trimethylolpropane, average particle diameter: 250 nm).

White Master Batch D

A white master batch D was prepared in the same manner as the white master batch A except that Tipaque CR-63 (manufactured by Ishihara Sangyo Kaisha Ltd., a product treated by a surface treating agent including titanium dioxide: aluminum, silicon, and siloxane, average particle diameter: 210 nm) was used in place of Tipaque PF-739 (manufactured by Ishihara Sangyo Kaisha Ltd., a product treated by a surface treating agent including titanium dioxide: aluminum, zirconia, and trimethylolpropane, average particle diameter: 250 nm).

Manufacturing of Pulverized Toner

Mother Toner A

| | |
|---|---|
| White master batch A | 600 parts |
| Polyester resin A (manufactured by Kao Corporation, Tg: 58.5° C.; softening point: 97° C.; major component: adduct of bisphenol A with ethylene oxide, terephthalic acid) | 200 parts |
| Polyester resin B (manufactured by Kao Corporation, Tg: 60.0° C.; softening point: 146° C.; major component: adduct of bisphenol A with ethylene oxide•propylene oxide, fumaric acid, trimellitic anhydride) | 130 parts |
| Carnauba/Rice wax (manufactured by CERA RICA NODA Co., Ltd., melting point: 82.0° C. ± 2.0° C., acid value: 4.5 ± 1.5 mg KOH/g) | 70 parts |

The recipe specified above were mixed and kneaded by passing it twice in an open roll kneader (Kneadex, manufactured by Nippon Coke & Engineering Co., Ltd.) in the following condition: temperatures at the front roll supply side and discharge side: 100° C. and 60° C., respectively; temperatures at the back roll supply side and discharge side: 40° C. and 30° C., respectively; the number of rotations of the front roll: 35 rpm; the number of rotations of the back roll: 31 rpm; gap: 0.25 mm. Thereafter, the mixture was pulverized by a pulvelizer (manufactured by Hosokawa Micron Corporation) and further ground by a jet mill, followed by classifying to prepare a mother toner A having a volume average particle diameter Dv of 6.0 μm and a ratio (volume average particle diameter/number average particle diameter) of 1.20 or less.

Mother Toner B

| | |
|---|---|
| White master batch B | 450 parts |
| Polyester resin A (manufactured by Kao Corporation, Tg: 58.5° C., softening point: 97° C., major component: adduct of bisphenol A with ehylene oxide, terephthalic acid) | 200 parts |
| Polyester resin B (manufactured by Kao Corporation, Tg: 60.0° C.; softening point: 146° C.; major component: adduct of bisphenol A with ethylene oxide•propylene oxide; fumaric acid; trimellitic anhydride) | 300 parts |
| Carnauba/rice wax (manufactured by CERA RICA NODA Co., Ltd., melting point: 82.0 ± 2.0° C., acid value: 4.5 ± 1.5 mg KOH/g) | 50 parts |

The above ingredients were mixed so as to obtain the above composition and the mixture was processed in the same manner as in the case of the toner mother body A to prepare a toner mother body B having a volume average particle diameter Dv of 6.0 μm and a ratio (volume average particle diameter/number average particle diameter) of 1.20 or less.

Mother Toner C

| | |
|---|---|
| White master batch A | 450 parts |
| Polyester resin C (manufactured by Kao Corporation, Tg: 64.5° C., softening point: 107° C., major component: bisphenol A ethylene oxide adduct, terephthalic acid) | 150 parts |
| Polyester resin D (manufactured by Kao Corporation, Tg: 64.0° C., softening point: 124° C.; major component: adduct of bisphenol A with ethylene oxide•propylene oxide adduct; terephthalic acid; trimellitic anhydride) | 350 parts |

-continued

| | |
|---|---|
| Synthetic ester wax WEP-9 (manufactured by Nippon Oil & Fats Co., Ltd., melting point: 79.0° C., acid value: 1.5 ± 0.5 mg KOH/g) | 50 parts |

The above ingredients were mixed so as to obtain the above composition and the mixture was processed in the same manner as in the case of the toner mother body A to prepare a toner mother body C having a volume average particle diameter Dv of 6.0 μm and a ratio (volume average particle diameter/number average particle diameter) of 1.20 or less.

Mother Toner D

| | |
|---|---|
| White master batch A | 750 parts |
| Polyester resin A (manufactured by Kao Corporation, Tg: 58.5° C.; softening point: 97° C.; major component: adduct of bisphenol A with ethylene oxide, terephthalic acid) | 50 parts |
| Polyester resin B (manufactured by Kao Corporation, Tg: 60.0° C., softening point: 146° C., major component: adduct of bisphenol A with ethylene oxide•propylene oxide, fumaric acid, trimellitic anhydride) | 130 parts |
| Glycerin wax (manufactured by Sakamoto Yakuhin Kogyo Co., Ltd., melting point: 71.3° C.; acid value: 3.4 mg KOH/g) | 70 parts |

The above ingredients were mixed so as to obtain the above composition and the mixture was processed in the same manner as in the case of the toner mother body A to prepare a toner mother body D having a volume average particle diameter Dv of 6.0 μm and a ratio (volume average particle diameter/number average particle diameter) of 1.20 or less.

Mother Toner E)

| | |
|---|---|
| White master batch C | 600 parts |
| Polyester resin A (manufactured by Kao Corporation, Tg: 58.5° C., softening point: 97° C., major component: adduct of bisphenol A with ethylene oxide, terephthalic acid) | 200 parts |
| Polyester resin B (manufactured by Kao Corporation, Tg: 60.0° C., softening point: 146° C., major component: bisphenol A ethylene oxide•propylene oxide adduct, fumaric acid, trimellitic anhydride) | 130 parts |
| Carnauba/rice wax (manufactured by CERA RICA NODA Co., Ltd., melting point: 82.0° C. ± 2.0° C., acid value: 4.5 ± 1.5 mg KOH/g) | 70 parts |

The above ingredients were mixed to obtain the above composition and the mixture was processed in the same manner as in the case of the toner mother body A to prepare a toner mother body E having a volume average particle diameter Dv of 6.0 μm and a ratio (volume average particle diameter/number average particle diameter) of 1.20 or less.

Mother Toner F

| | |
|---|---|
| White master batch D | 600 parts |
| Polyester resin C (manufactured by Kao Corporation, Tg: 64.5° C., softening point: 107° C., major component: adduct of bisphenol A with ethylene oxide, terephthalic acid) | 200 parts |
| Polyester resin D (manufactured by Kao Corporation, Tg: 64.0° C., softening point: 124° C., major component: adduct of bisphenol A ethylene oxide•propylene oxide, terephthalic acid, trimellitic anhydride) | 130 parts |

-continued

| | |
|---|---|
| Synthetic ester wax WEP-9 (manufactured by Nippon Oil & Fats Co., Ltd., melting point: 79.0° C., acid value: 1.5 ± 0.5 mg KOH/g) | 70 parts |

The above ingredients were mixed so as to obtain the above composition and the mixture was processed in the same manner as in the case of the toner mother body A to prepare a toner mother body F having a volume average particle diameter Dv of 6.0 μm and a ratio (volume average particle diameter/number average particle diameter) of 1.20 or less.

Mother Toner G

| | |
|---|---|
| White master batch A | 600 parts |
| Polyester resin A (manufactured by Kao Corporation, Tg: 58.5° C., softening point: 97° C., major component: adduct of bisphenol A with ethylene oxide, terephthalic acid) | 200 parts |
| Polyester resin B (manufactured by Kao Corporation, Tg: 60.0° C., softening point: 146° C., major component: bisphenol A ethylene oxide•propylene oxide adduct, fumaric acid, trimellitic anhydride) | 160 parts |
| Paraffin wax (manufactured by Nippon Seiro Co., Ltd., melting point: 75.5° C. ± 1.5° C., acid value: none) | 40 parts |

The above ingredients were mixed so as to obtain the above composition and the mixture was processed in the same manner as in the case of the toner mother body A to prepare a toner mother body G having a volume average particle diameter Dv of 6.0 μm and a ratio (volume average particle diameter/number average particle diameter) of 1.20 or less.

Mother Toner H

| | |
|---|---|
| White master batch A | 600 parts |
| Polyester resin A (manufactured by Kao Corporation, Tg: 58.5° C., softening point: 97° C., major component: bisphenol A ethylene oxide adduct, terephthalic acid) | 200 parts |
| Polyester resin B (manufactured by Kao Corporation, Tg: 60.0° C., softening point: 146° C., major component: adduct of bisphenol A with ethylene oxide•propylene oxide, fumaric acid, trimellitic anhydride) | 150 parts |
| Microcrystalline wax (manufactured by Seiro Co., Ltd., melting point: 87.0° C. ± 1.0° C., acid value: none) | 50 parts |

The above ingredients were mixed so as to obtain the above composition and the mixture was processed in the same manner as in the case of the toner mother body A to prepare a toner mother body H having a volume average particle diameter Dv of 6.0 μm and a ratio (volume average particle diameter/number average particle diameter) of 1.20 or less.

Mother Toner I

| | |
|---|---|
| White master batch A | 600 parts |
| Styrene acryl resin A (manufactured by Sanyo Chemical Industries, Ltd., Tg: 62.5° C., softening point: 97° C., major component: styrene, butyl acrylate) | 200 parts |
| Styrene acryl resin B (manufactured by Kao Corporation, Tg: 63.0° C., softening point: 140° C., major component: styrene, BA) | 130 parts |
| Carnauba/rice wax (manufactured by CERA RICA NODA Co., Ltd., melting point: 82.0° C. ± 2.0° C., acid value: 4.5 ± 1.5 mg KOH/g) | 70 parts |

The above ingredients were mixed to obtain the above composition and the mixture was processed in the same manner as in the case of the toner mother body A to prepare a toner mother body I having a volume average particle diameter Dv of 6.0 μm and a ratio (volume average particle diameter/number average particle diameter) of 1.20 or less.

Mother Toner J

Preparation of Releasing Agent Liquid Dispersion A]

A liquid dispersion having the following composition containing a resin serving as a binder resin and a releasing agent serving as a releasing agent was prepared.

100 parts by weight of a polyester A (SREX-005L, manufactured by Sanyo Chemical Industries, Ltd., Tg: 58° C., Mw: 7600) used as a binder resin, 100 parts by weight of a wax dispersion resin (RSWD-A, manufactured by Sanyo Chemical Industries, Ltd.), and 200 parts by weight of carnauba/rice wax (manufactured by CERA RICA NODA Co., Ltd., melting point: 82.0° C.±2.0° C., acid value: 4.5±1.5 mg KOH/g) were stirred and dispersed in 600 parts by weight of ethyl acetate using a mixer equipped with a stirring blade for 10 minutes in the same manner as in the preparation of the master batch. Thereafter, the obtained liquid dispersion was dispersed by using a dyno-mill for 8 hours to obtain a releasing agent liquid dispersion A.

Preparation of Toner Composition Solution J

| | |
|---|---|
| White master batch A | 600 parts |
| Releasing agent liquid dispersion A | 350 parts |
| Polyester A (SREX-005L, manufactured by Sanyo Chemical Industries, Ltd., Tg: 58° C., Mw: 7600) | 130 parts |
| Polyester B (manufactured by DIC Corporation, Tg: 61° C., softening point: 130° C.) | 130 parts |
| Ethyl acetate | 790 parts |

The above ingredients were mixed to obtain the above composition and the mixture was dissolved and dispersed by using a mixer equipped with a stirring blade to prepare a white toner composition solution J.

Preparation of Resin Particulate Emulsion 683 parts by weight of water, 11 parts by weight of a sodium salt of an ethylene oxide methacrylate adduct sulfate (Eleminol RS-30, manufactured by Sanyo Chemical Industries, Ltd.), 79 parts by weight of styrene, 79 parts by weight of methacrylic acid, 105 parts by weight of butyl acrylate, 13 parts by weight of divinylbenzene, and 1 part by weight of ammonium persulfate were placed in a reaction container equipped with a stirrer and a temperature gauge. The mixture was stirred at 400 rpm/min for 15 minutes to obtain a white emulsion. The emulsion was heated to 75° C. as a system temperature to conduct reaction for hours. Thereafter, 30 parts by weight of an aqueous 1% by weight ammonium persulfate solution was added to the mixture, which was aged at 75° C. for 5 hr to obtain an aqueous liquid dispersion [particulate liquid dispersion] of a vinyl resin (copolymer of styrene-methacrylic acid-butyl acrylate-sodium salt of ethylene oxide methacrylate adduct sulfate).

The obtained [particulate liquid dispersion] was measured by a laser diffraction type particle size analyzer (LA-920, manufactured by Horiba Ltd.) and had a volume average particle diameter of 105 nm. A part of the "particulate liquid dispersion" was dried to isolate a resin component. The resin component had a glass transition temperature (Tg) of 95° C., a number average molecular weight of 140,000, and a weight average molecular weight of 980,000.

Preparation of Aqueous Medium Phase

An aqueous medium phase (aqueous medium) was prepared by uniformly dissolving 306 parts by weight of deionized water, 60 parts by weight of a resin particulate liquid dispersion, and 4 parts by weight of sodium dodecylbenzenesulfonate.

Preparation of Emulsion/Liquid Dispersion

In a container installed in a water bath controlled at 60° C., 200 parts by weight of the above aqueous medium was put and stirred using a TK type homo mixer (manufactured by Primix Corporation) operated at 10,500 rpm. Thereafter, 100 parts by weight of the above white toner composition solution controlled at 60° C. in the same manner as above was added to the medium, which was mixed for 2 minutes and thereafter converged at 4500 rpm for an optional time such that the mixture had a volume average particle diameter Dv of 6.0 μm and a ratio (a volume average particle diameter/number average particle diameter) of 1.15±0.2 to obtain an emulsion/liquid dispersion (emulsion-liquid dispersion: emulsion slurry).

Removal of Organic Solvent 100 parts by weight of the emulsion slurry was placed in a flask equipped with a stirrer and a temperature gauge and stirred at 30° C. at a stirring peripheral speed of 20 m/min to remove the solvent in 12 hours.

Washing and Drying

After 100 parts by weight of slurry dispersion was filtered under reduced pressure, 100 parts by weight of deionized water was added to the filter cake and mixed (at 12000 rpm for 10 minutes) by a TK type HOMOMIXER (manufactured by Primix Corporation), followed by filtration. 300 parts by weight of deionized water was added to the obtained filter cake followed by mixing by a TK type homo mixer (12000 rpm, 10 min) and filtration, which was repeated twice. 20 parts by weight of an aqueous 10% by weight sodium hydroxide solution was added to the filter cake, and mixed (12000 rpm, 30 min) by a TK type HOMOMIXER, followed by filtering under a reduced pressure.

300 parts by weight of deionized water was added to the obtained filter cake, which was mixed by a TK type homo mixer (12000 rpm, 10 min), followed by filtration. Thereafter, 300 parts by weight of deionized water was added to the obtained filter cake followed by mixing by a TK type HOMOMIXER (12000 rpm, 10 min) and filtration, which was repeated twice. Further, 20 parts by weight of 10% by weight hydrochloric acid was added to the obtained filter cake, mixed by a TK type HOMOMIXER (12000 rpm, 10 min), and filtered. Thereafter, 300 parts by weight of deionized water was added to the obtained filter cake followed by mixing by a TK type HOMOMIXER (12000 rpm, 10 min) and filtration, which was repeated twice to obtain a final filter cake.

The obtained final filter cake was dried at 45° C. for 48 hour by using a circulating air drier and screened through a 75 μm-opening mesh to obtain mother toner particle J.

In this case, it is confirmed that when the temperature of the toner composition solution is 60° C., used carnauba/rice wax is melted in an organic solvent.

Mother Toner K

Mother Toner K was prepared in the same manner as Mother Toner J except that, in Preparation of Emulsion/Liquid Dispersion, the aqueous medium and toner composition solution were processed at room temperature (22° C.) without the temperature control.

Mother Toner L

Preparation of Toner Composition Solution L

| | |
|---|---|
| White master batch A | 600 parts |
| Releasing agent liquid dispersion A | 350 parts |
| Polyester C (urethane modified crystalline polyester, manufactured by Sanyo Chemical Industries, Ltd., melting point: 63° C., Mw: 30000) | 260 parts |
| Ethyl acetate | 790 parts |

The recipe specified above were mixed followed by dissolution and dispersion at 60° C. by using a mixer equipped with a stirring blade to prepare a white toner composition solution L.

Mother Toner L was obtained in the same manner as Mother Toner L except for the above mentioned.

Evaluation 1: Confirmation of Dispersion State of Pigment and Wax by TEM Observation Each of Mother Toner Particles A to L was encapsulated in an epoxy resin and cut into flakes by using a Ultramicrotome ULTRACUT-S (manufactured by RAICA Co., Ltd.) to observe its section by TEM.

These mother toner particles A, B, C, D, J, and L were each dispersed in the toner in the condition that the white pigment particles were coated with the releasing agent. Also, these mother particles E, F, G, H, I, and K were each in the condition that the white pigment and the releasing agent were separately dispersed. With regard to Mother Toner Particles G and H, it was considered that the white pigment and the releasing agent were separately dispersed because non-wettable and nonpolar wax was used for the surface of the white pigment.

Figure 2:
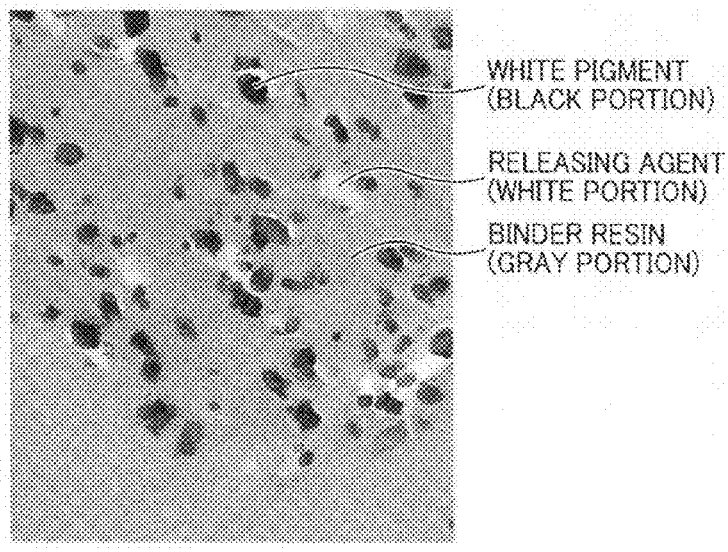
FIG. 2 is a photograph illustrating a cross-section of toner of a Comparative Example described later.

FIG. 1 illustrates a cross-sectional TEM observation photograph of the mother toner particle A and FIG. 2 illustrates a cross-sectional photograph of the mother toner particle E as examples.

Further, 1.5 parts of hydrophobic silica (HDK H2000, manufactured by Wacker Chemie GmbH, particle diameter: 10 nm) and 1.0 part of hydrophobic titania oxide (MT-150AI, manufactured by TAYKA Corporation, particle diameter: 15 μm) were externally added to 100 parts of each of these mother toner particles A to L by a HENSCHEL MIXER to obtain ground toners A to L.

Each toner obtained as described above was mixed with the following toner carrier to prepare a development agent.

Manufacturing of Carrier

Spherical ferrite particles used as a core material and having a volume average particle diameter of 35 μm were coated with a coating material constituted of a mixture of a silicone resin and a melamine resin to prepare toner carrier.

Production of Development Agent

Using a turbula mixer, 10 parts by weight of each of the toners and 90 parts by weight of the carrier were mixed to produce a two-component development agent.

An image formation test was conducted as follows.

Image Forming Apparatus

To evaluate each white toner obtained in Examples and Comparative Examples, an experimental machine was manufactured by connecting a digital full-color copy machine with a digital monochrome copy machine.

As the digital full-color copy machine, imagio MP C4500 (evaluation machine A) manufactured by Ricoh Co., Ltd. was remodeled and used. As the digital monochrome copy machine, imagio Neo 453 (evaluation machine B) manufactured by Ricoh Co., Ltd. was remodeled and used. The digital full-color copy machine used proper standard full-color toner and a sheet or a transparent sheet discharged from the fixing section therein was fed to the digital monochrome copy machine. In this case, the full-color toner used in the imagio MP C4500 manufactured by Ricoh Co., Ltd. was produced by the polymerization method.

Each white toner obtained in Examples and Comparative Examples was set in the digital monochrome copy machine and evaluated. In the digital monochrome copy machine, the coating amount of the white toner was adjusted to about 1.0 $mg/cm^2$ to form a solid image.

Sample Image

A sample image was obtained by forming a full-color image on a transparent film and furthermore forming a white toner image on the whole surface of the full-color image. The sample image was formed to view a full-color image from the film side (reverse side of the image side).

As the transparent film, CG3700 (manufactured by Sumitomo 3M Limited) was used. A highly precise color digital standard image data (ISO/JIS-SCID sample N5 bicycle) was printed as a full-color image.

Evaluation Items and Evaluation Method

Bending Test

A highly precise color digital standard image data (ISO/JIS-SCID sample N5 bicycle) was printed as a full-color image on a transparent film (trade name: CG3700, manufactured by Sumitomo 3M Limited) by using the evaluation machine A and a white toner image was further formed on the full-color image all over the surface of the film by the evaluation machine B to evaluate the strength of the resulting image.

In the bending test, the transparent film was bent with the toner fixed surface facing outward to measure the curvature R (mm) of the transparent film when the toner was peeled off.

The toners were evaluated according to the following criteria:

⦿ (Excellent): R≤1 nm

○ (Good): 1 nm<R≤2 mm

Δ (Fair): 2 mm<R≤4 mm

X (Bad): 4 mm<R

Clear difference was observed in this evaluation.

Rubbing Test

A print image was formed in the same manner as in the bending test and rubbed by a JIS smear cloth (JIS L 0849) using a clock meter (Model 1 manufactured by Atras Electric Devices Co.,) to observe whether or not the toner was peeled off followed by evaluation according to the following criteria:

○ (Good): No toner peeled off

X (Bad): Toner peeled off

In this evaluation, no large difference was observed between each toner.

Charge Size (Q/M))

After the evaluation machine B was used to print 1000 copies of an image chart having a 5% image area, the charge size (Q/M) of the development agent of the white toner was measured by a blow-off device followed by evaluation according to the following criteria.

○ (Good): ΔQ/M (=Initial charge size—Charge size after 1000 copies|/|Initial charge size|)≤10%

Δ (Fair): 10%<ΔQ/M≤40%

X (Bad): 40%<ΔQ/M

In this evaluation, a clear difference was observed between each toner.

Whiteness

A white solid image of the white toner formed on the entire surface by the evaluation machine B was placed on black paper having an image density (ID) value of 1.80 or more to confirm the whiteness of the image by the ID value. The ID value was measured by X-TITE 938.

The evaluation was made according to the following criteria:

⦿ (Excellent): ID≤0.2

○ (Good): 0.2<ID≤0.25

Δ (Fair): 0.25<ID≤0.3

X (Bad): 0.3<R

In this evaluation, no large difference was observed between toners except that the content of titanium dioxide was different.

Fixability

Using the evaluation machine A, a solid image was formed on transfer paper of plain paper and thick paper (type 6200 manufactured by Ricoh Co., Ltd and copy printing sheet <135> manufactured by Ricoh Co., Ltd.), such that the toner coating amount was 1.00±0.1 $mg/cm^2$ to measure the lowest fixing temperature.

The lowest fixing temperature was measured in a drawing test and defined as the temperature below which scraping occurs.

The evaluation was made according to the following criteria:

⦿ (Excellent): lowest fixing temperature ≤120° C.

○ (Good): 120° C.<lowest fixing temperature ≤135° C.

Δ (Fair): 135° C.<lowest fixing temperature ≤150° C.

X (Bad): 150° C.<R

In this evaluation, a clear difference was observed between toners.

The results of evaluation are shown in Table 1.

TABLE 1

| | Toner | Bending test | Rubbing test | Charge amount | White-ness | Lowest fixing tem-perature |
|---|---|---|---|---|---|---|
| Example 1 | Toner A | ⦿ | ○ | ○ | ⦿ | ○ |
| Example 2 | Toner B | ⦿ | ○ | ○ | ○ | ○ |
| Example 3 | Toner C | ⦿ | ○ | ○ | ○ | ○ |
| Example 4 | Toner D | ⦿ | ○ | ○ | ○ | ○ |
| Comparative Example 1 | Toner E | X | ○ | X | ○ | X |
| Comparative Example 2 | Toner F | X | ○ | X | ○ | X |
| Comparative Example 3 | Toner G | X | ○ | X | ○ | X |
| Comparative Example 4 | Toner H | X | ○ | X | ○ | X |
| Comparative Example 5 | Toner I | X | ○ | X | ○ | X |
| Example 5 | Toner J | ⦿ | ○ | ○ | ○ | ○ |
| Comparative Example 6 | Toner K | X | ○ | Δ | ○ | Δ |
| Example 6 | Toner L | ○ | ○ | ○ | ○ | ⦿ |

As seen in the evaluation results, the present disclosure provides white toner which is suitable for a low-temperature fixing system and has sufficient image strength and good chargeability, high masking ability to form good white images. In addition, a development agent, a recording medium, a printed matter, an image forming method, an image forming apparatus, and a process cartridge using the white toner are provided.

According to the present disclosure, the thermal properties, the fixability, and the chargeability of the binder resin are not adversely affected even if a large quantity of the white pigment is added. In addition, the masking characteristics are secured even if the amount of the toner is small, which facilitates image forming without an adverse impact in producing a full-color image.

Having now fully described embodiments of the present invention, it will be apparent to one of ordinary skill in the art that many changes and modifications can be made thereto without departing from the spirit and scope of embodiments of the invention as set forth herein.

What is claimed is:

1. A white toner, comprising:

a binder resin;

a white pigment; and a releasing agent, wherein the white pigment is coated with the releasing agent and the white pigment is dispersed in the binder resin, and wherein the white pigment is surface-treated with a surface treating agent comprising aluminum and at least one of trimethylolpropane and trimethylolethane.

2. The white toner according to claim 1, wherein the binder resin is a polyester resin.

3. The white toner according to claim 1, wherein the white pigment is titanium dioxide.

4. The white toner according to claim 1, wherein the white pigment is surface-treated with a polyol.

5. The white toner according to claim 1, wherein the releasing agent is a low-molecular weight organic material having an acid value from of 1.0 mg KOH/g to 6.0 mg KOH/g.

6. The white toner according to claim 1, wherein the white pigment is surface-treated with a surface treating agent comprising aluminum and trimethylolpropane.

7. The white toner according to claim 1, wherein the white pigment accounts for 30% by weight to 50% by weight of the white toner.

8. The white toner according to claim 2, wherein the polyester resin has a glass transition point of from 40° C. to 80° C.

9. The white toner according to claim 2, wherein the polyester resin comprises a crystalline polyester at least part of which is urethane- or urea-modified.

10. A method for producing the white toner of claim 1, the method comprising:

melt-kneading the binder resin, the white pigment, and the releasing agent in a temperature condition under which the releasing agent is melted to form a kneaded material followed by grinding and classification thereof, or mixing and dispersing the binder resin, the white pigment, and the releasing agent in a temperature condition under which the releasing agent is melted in an organic solvent to prepare a toner composition solution followed by dispersion and emulsification of the toner composition solution in an aqueous medium phase in the temperature condition, wherein the white pigment is titanium dioxide and the releasing agent is an organic low-molecular material having an acid value of from 1.0 mg KOH/g to 6.0 mg KOH/g.

11. A development agent, comprising:

the white toner of claim 1; and a toner carrier.

12. A recording medium, comprising:

a substrate; and a white image layer, formed on at least one surface of the substrate, using the white toner of claim 1.

13. A printed matter, comprising:

a substrate;

a color image layer; and a white image layer formed of the white toner of claim 1.

14. An image forming apparatus, comprising:

a white image forming device to form a white image using the white toner of claim 1.

15. The white toner according to claim 1, wherein the white pigment is surface-treated with a surface treating agent comprising aluminum and trimethylolethane.

16. The white toner according to claim 1, wherein the white pigment is surface-treated with a surface treating agent comprising aluminum and both trimethylolpropane and trimethylolethane.

* * * * *